US005426898A

United States Patent [19]

Larsen

[11] Patent Number: 5,426,898

[45] Date of Patent: Jun. 27, 1995

[54] LEADFREE ROOF FLASHING MATERIAL

[75] Inventor: Niels A. Larsen, Rodovre, Denmark

[73] Assignee: V. Kann Rasmussen Industri A/S, Soborg, Denmark

[21] Appl. No.: 79,506

[22] Filed: Jun. 22, 1993

Related U.S. Application Data

[63] Continuation-in-part of Ser. No. 873,798, Apr. 27, 1992, abandoned.

[30] Foreign Application Priority Data

Sep. 26, 1991 [DK] Denmark ..... 1643/91

[51] Int. Cl.[6] ..... B32B 3/28; E04D 13/14

[52] U.S. Cl. ..... 52/58; 520/785; 520/809; 428/152; 428/181

[58] Field of Search ..... 52/809, 785, 108, 396.04, 52/406.1, 406.2, 58; 428/163, 164, 165, 166, 462, 152, 167, 162, 181, 182

[56] References Cited

U.S. PATENT DOCUMENTS

| | | | |
|---|---|---|---|
| 2,154,640 | 4/1939 | Romanoff | 428/181 |
| 2,622,051 | 12/1952 | Hermanson et al. | 428/181 |
| 3,018,205 | 1/1962 | Barut | 428/181 |
| 3,355,845 | 12/1967 | Allersma | 428/181 |
| 3,732,656 | 5/1973 | Robinsky | 52/108 |
| 4,573,296 | 3/1986 | Wrigley | 52/108 |

FOREIGN PATENT DOCUMENTS

| | | | |
|---|---|---|---|
| 123788 | 3/1947 | Australia | 428/181 |
| 145509 | 10/1981 | Denmark . | |
| 148064 | 10/1981 | Denmark . | |
| 6194/86 | 12/1986 | Denmark . | |
| 5059/89 | 10/1989 | Denmark . | |
| 0123141 | 10/1984 | European Pat. Off. . | |
| 1658907 | 2/1971 | Germany . | |
| 3046861 | 7/1982 | Germany . | |
| 321555 | 3/1970 | Sweden . | |
| 1095393 | 12/1967 | United Kingdom . | |
| 1215137 | 12/1970 | United Kingdom . | |

*Primary Examiner*—Michael Safavi
*Attorney, Agent, or Firm*—Lane, Aitken & McCann

[57] ABSTRACT

A lead-free plate-shaped roof flashing material comprises a sandwich structure in which a stress damping and stabilizing layer of ductile material is completely covered on one side and at least partly covered on the other side by preferably metallic foil sheetings, e.g. of aluminum foil, designed with densely positioned flattened folded sections having such a form, e.g. closed inverted pleats, that a material layer of each folded section gets into contact with the stress damping and stabilizing layer only when the folded sections open in connection with deforming the flashing material to make it fit to the roofing.

11 Claims, 4 Drawing Sheets

LEADFREE ROOF FLASHING MATERIAL

Figure 1:
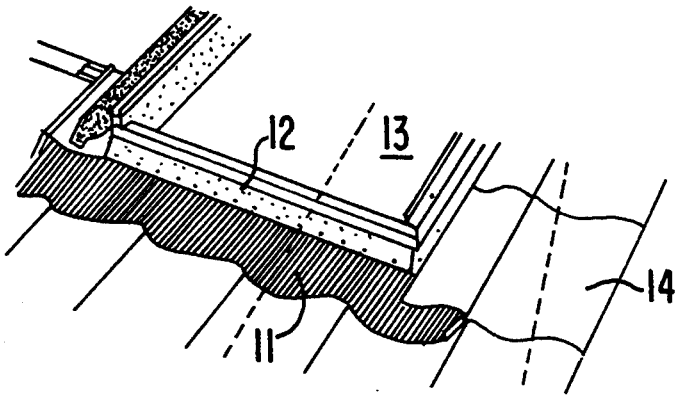

The present application is a continuation-in-part of U.S. patent application Ser. No. 873,798, filed Apr. 27, 1992 now abandoned.

The invention relates to lead-free roof flashing materials for providing a weathertight joint between an inclined roof surface and a main frame portion of a skylight.

Such flashing materials are conventionally used in particular to form weathertight joining skirts between the lower horizontal frame member of a skylight main frame and the underlying roof covering which may be formed of conventional tiles or other waveformed roofing materials.

Traditionally, flashing materials of this kind have been formed by lead plates of a thickness of typically 1 mm. In particular for wave-formed roof coverings such as tiles having relatively deep troughs the necessary deformation of such plates to follow the waveform of the roof covering has frequently required hammering which involves a considerable risk of cracks and breakages in the flashing material.

To avoid this drawback and provide a flashing material which is sufficiently deformable solely by manual processing flashing structures have been disclosed in Danish Patents Nos. 148 064 and 145 509 as well as published Danish Patent Application No. 5059/89 in which the deformability has been increased either by wave corrugation of the flashing material or by designing it with spaced apart parallel flat-folded sections between which the material may, in addition, be wave-corrugated.

According to the two former Danish patents the economical and environmental problems involved in the traditional use of lead has moreover been avoided by providing flashing materials in the form of leadfree sandwich structures composed of a thin metal foil and a pressure adhesive coating, e.g. of bitumen. After having been manufactured in a flat condition these sandwich structures are corrugated as a whole into an omega-like waveform in which the cross-sectional dimension of each wave is larger than the width of the slit aperture of the wave.

In case of wave-shaped roof coverings, e.g. in the form of tiles with relatively deep troughs it has appeared difficult, however, even with this design to obtain a sufficient manual deformability to provide the required weather tightness between the flashing skirt and the roof covering and despite the intended manual deformability it has frequently been necessary to undertake deformation by using a pressing or hammering tool.

From published Danish Patent Application No. 6194/86 a deformable flashing or sealing material is known in which a stretchable metal grid e.g. of aluminium is embedded in a polyisobutylene substrate which is non-adhesive in the relevant temperature range. Since with the prior art material the surfaces of the substrate are not covered by any productive layer the material is less resistant to mechanical damage than conventional lead flashings.

It is the object of the present invention to eliminate the disadvantages associated with prior art flashing materials at least substantially while maintaining the improvement of a leadfree design.

According to the invention a leadfree flashing material is provided comprising a manually deformable sandwich structure including a stress damping and stabilizing core layer of a ducile material, a first foil sheeting completely covering one side of said core layer and a second foil sheeting at least partly covering the opposite side of said core layer, each of said foil sheetings having a thickness substantially less than said core layer and being preferably made of a metallic material and being shaped into flat-folded pleat sections each comprising at least one inner layer in contact with said core layer, at least one intermediate layer extending substantially parallel with and close to said inner layer and joining said inner layer in a first folding line and an outer layer extending substantially parallel with and close to said intermediate layer and joining said layer in a second folding line parallel to said first folding line, a pair of said folding lines extending at such a small distance from one another as to prevent said outer layer from contacting said core layer in a non-deformed state of said sandwich structure, but permit said outer layer to be contacted by said core layer upon an increase of said distance caused by manual deformation of said sandwich structure.

As distinct from the referenced prior art sandwich structures, it is only the foil sheetings of the flashing material according to the invention that are shaped into said flat folded sections.

In the undeformed condition of the flashing material the stress damping and stabilizing core layer between the foil sheetings is merely in contact with the inner layers of each pleat section. When the flashing material by adaption to a waveshaped roofing is being deformed the folded sections however open and the stress damping and stabilizing core layer is stretched and place into adhering contact with the outer layer of the folded sections now opened.

To obtain this function it is according to the intention preferred that the stress damping and stabilizing layer is made from a material which is stretchable and adhesive in the relevant range of temperature, e.g. between −5° and 60°.

In the preferred embodiment the first folding lines in each of said inverted pleat sections extend densely close to one another.

The foil sheetings may advantageously according to the invention be made from aluminium foil having a thickness in the range from 0.1 to 0.5 mm.

In an embodiment in which the stress damping and stabilizing core layer is completely encapsulated between two foil sheetings, one of which has apertures or perforations in the outwards facing parts of the inverted pleats, an improved adhesion to the underlying roof is obtained.

In an embodiment of the roof flashing material suitable for industrial production the first and second foil sheetings are formed by a single foil sheeting which is folded around said core layer along a folding line extending substantially perpendicular to said first and second folding lines, whereas the free edges of said single foil are squeezed together.

Figure 4:
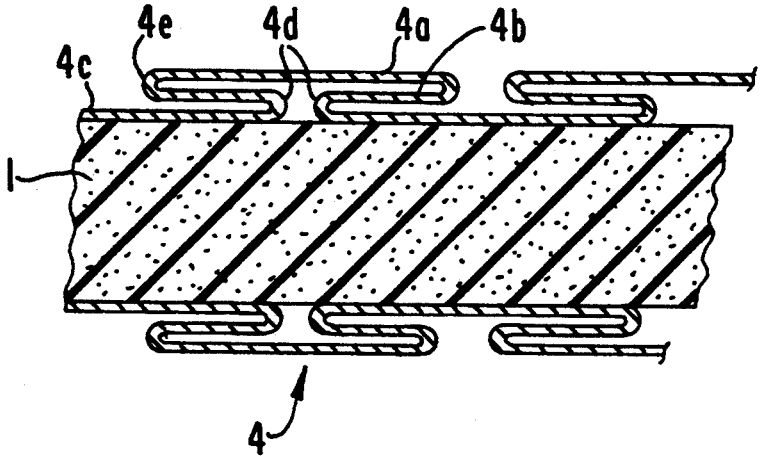
Figure 2:
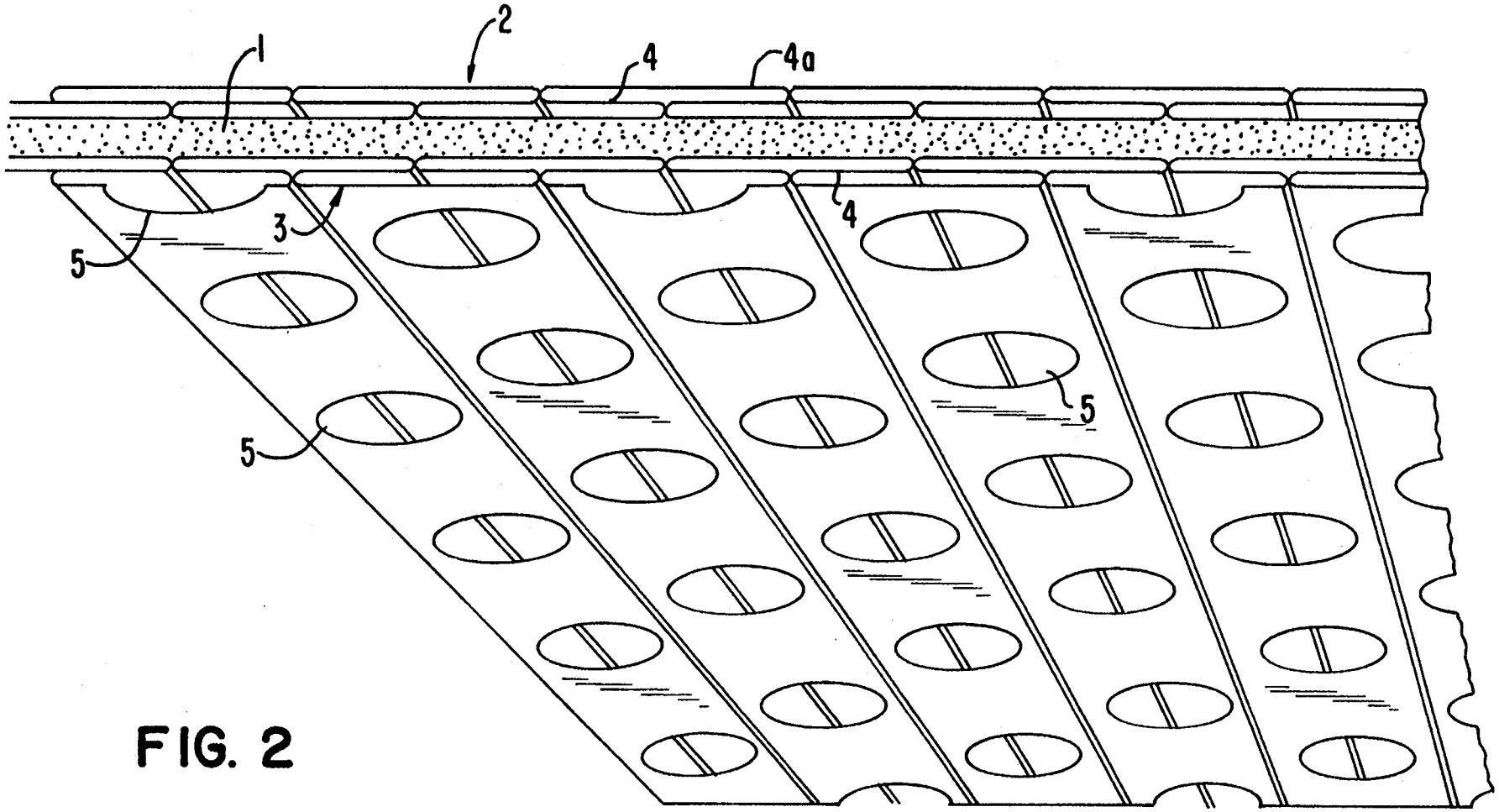
Figure 3:
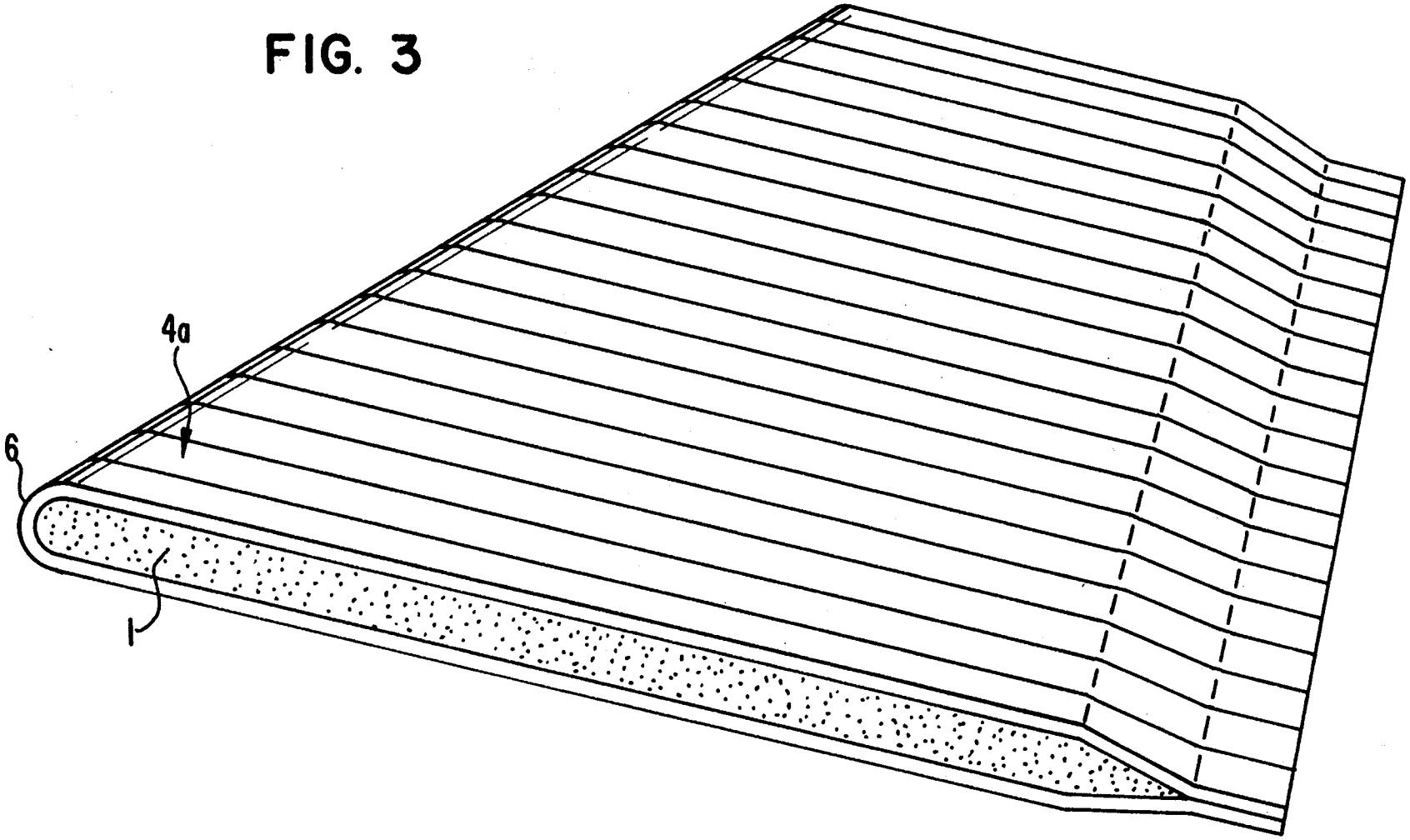

The invention will now be explained in detail with reference to the drawings, in which FIG. 1 shows a skylight mounted in an inclined roof surface with a waveshaped roof covering and provided with a flashing skirt to provide a weather tight joint between a lower horizontal mainframe member and the roof covering, FIGS. 2 and 3 are two perspective illustrations partially in a sectional view of an embodiment of a plate shaped flashing material according to the invention, FIG. 4 is an enlarged cross-sectional view of a part of the sandwich structure of the flashing material shown in FIG. 2 in a non-deformed state, and FIG. 5 a schematic cross-sectional view serving to illustrate deformation of the flashing material when adapting it to a roof surface.

FIG. 1 show a typical use of a flashing material according to the invention to provide a weather tight skirt 11 secured to a flashing 12 or the lower horizontal main frame member of a skylight 13 arranged in a inclined roof surface having a wave-shaped form composed of conventional tiles 14 forming relatively deep valley or troughs between the wave tops.

In order to conform to the waveform of the roof covering the skirt 11 is manually deformed whereby the parts of the skirt which are on the wave tops of the roof covering are pressed firmly by hand against the wave tops and are thereby considerably stretched.

In the embodiment illustrated in FIGS. 2 to 4 the flashing material comprises a sandwich structure including a stress damping and stabilizing core layer 1, that may be of a ductile and plastically deformable material based on isobutylene-isoprene rubber having a stretchable and adhesive consistency in the relevant range of temperature, e.g. from −5° to 60°. The core layer is completely encapsulated between first and second foil sheetings 2 and 3 that are formed integrally from a single member of foil material and folded around the layer 1 while being squeezed together along the remaining lateral edges of the flashing plate member.

The foil sheetings 2 and 3 may be made from aluminium foil with a thickness substantially less than the thickness of the core layer 1 e.g. in the range from 0.1 to 0.5 mm. As a further corrosion protecting measure such aluminum foil sheetings may be lacquered or painted by conventional means.

As most clearly seen in the enlarged cross-sectional view in FIG. 4, the foil sheetings 2 and 3 are in the illustrated embodiment shaped into flat folded sections 4 of an inverted pleat shape. Each pleat section may typically have a width of 6 to 10 mm and comprise two inner layers **4*c* in contact with the core layer 1, two intermediate layers 4*b* joining the inner layers 4*a* in a pair of parallel first folding lines 4*d* and extending substantially parallel and close to the inner layers 4*c*, and an outer layer 4*a* joining the intermediate layers 4*b* in a pair of second folding lines 4*e* and extending substantially parallel with and close to the intermediate layers 4*b***.

As further apparent from FIG. 4 the pair of first folding lines **4*d* extend at a relatively small distance from one another so that in the non-deformed state of the sandwich structure shown in FIG. 4 the outer layer 4*a* of each pleat section can not get into contact with the core layer 1**.

Figure 5:
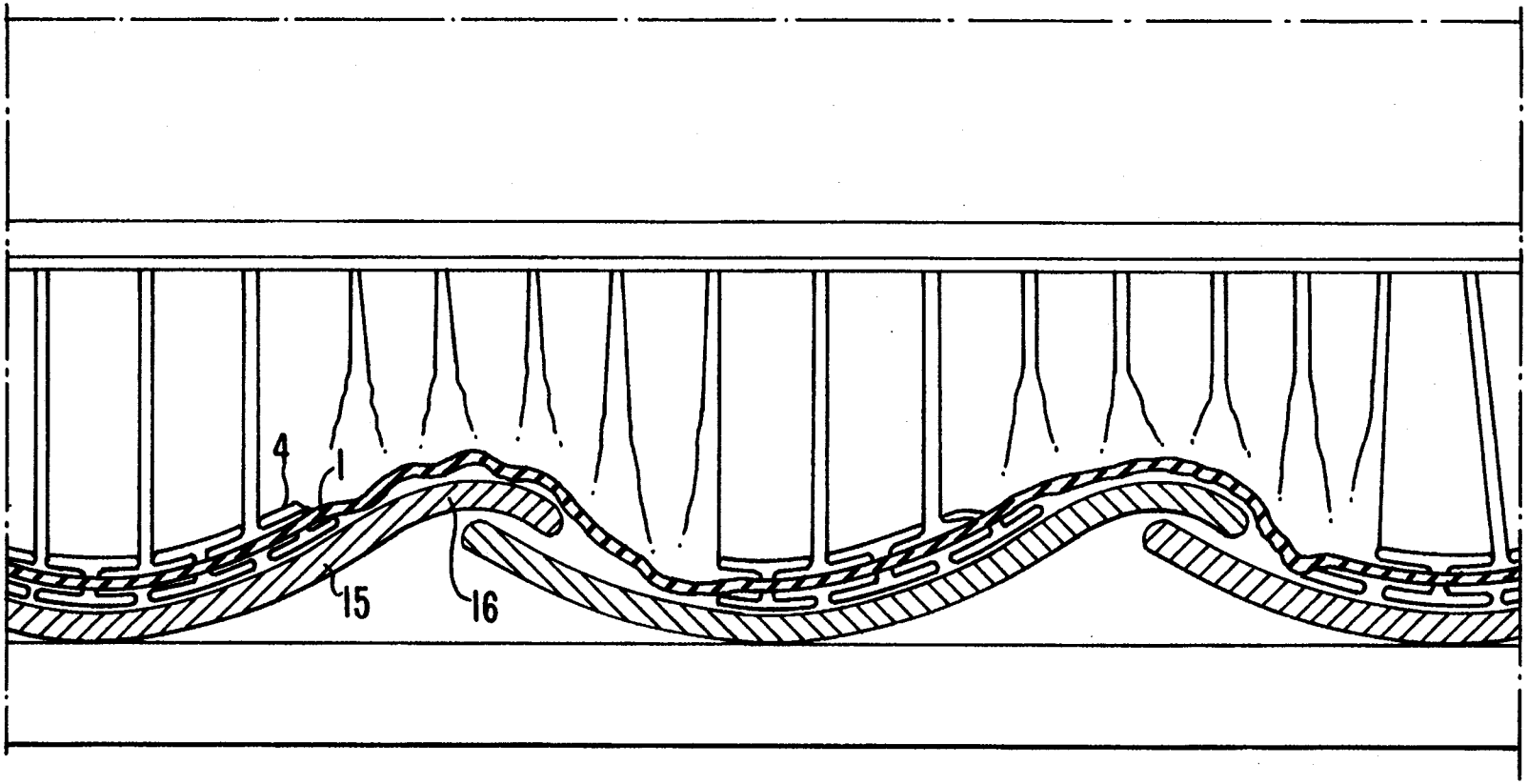

However, as schematically illustrated in FIG. 5 when the sandwich structure is deformed by manual processing to conform to the shape of a wave shaped roof covering composed of tiles 15 whereby it will be stretched, in particular over the wavetops 16 of the roofing, whereby the pleat sections 4, the inner layer **4*c* of which remains in frictional engagement with the ductile core layer 1 will be unfolded and opened to increase the distance between the first folding lines 4*d* whereby the ductile core layer 1** may get into contact with the outer layer of the foil sheeting.

In the illustrated embodiment the pleat sections 4 extend densely close to one another thereby offering the possibility of stretching the flashing material by almost 100% in a direction perpendicular to the folded sections and thus an easy adaption to the roofing by a purely manual deformation processing without any use of tools. There is, however, nothing to prevent larger spacings between the folded sections.

After initial stressing and adaption to the underlying roofing has taken place a final manual compression of the skirt may be carried out to stabilize the connection between the pleat sections and the roofing 8. Experiments have shown that by means of the flashing material according to the invention a stable reinforced shielded joint is provided which can withstand even heavy storms despite the fact that the weight of a skirt produced of the flashing material is substantially lower than the weight of a conventional lead skirt.

In view of this stretching the stress damping and stabilizing core layer has a thickness, preferably in the range from 1 to 6 mm.

In the illustrated embodiment an improved securing to the roofing is made possible by providing the foil sheeting 3, which upon mounting the flashing material is positioned against the roofing, with apertures or perforations 5 in the outer layers **4*a* of the pleat section 4 so that the core layer 1 when the inverted pleats 4 are opened by deformation is partially urged through said apertures 5** to get into adhering contact with the roofing.

A second possibility of such an adhesion to the roofing consists in that part of the actual side of the flashing sandwich structure may be free of foil coating and for instance when delivered be covered by a removable protective paper.

The illustrated embodiment, however, presents the advantage that it entails a better protection of the core layer 1 against deteriorating climatic changes, thereby making less heavy demands on the stability of the adhesive substance against such influences.

The flashing material may be manufactured in that the core layer 1 is wound or rolled on one half of a foil blank cut in a rectangular form and provided beforehand with densely positioned pleat sections 4, following which the foil blank is folded along a folding line 6 perpendicular to the folded sections and the folded foil sheetings are squeezed together or-adhered on the three remaining lateral edges.

The use of aluminium foil makes it possible to produce flashing materials with an effective surface protection against climatic influences and in various desired colours.

As an alternative, for use in connection with copper roofs covering a thin copper foil may be used.

The design of the folded sections 4 as inverted pleats entails an optimum combination of stretchability and ductility by purely manual processing but the folded sections may as a second possibility have a flattened Z-shaped form of the same type which was per se known in connection with leaded flashings prior to the above referenced Danish Patent Application No. 5059/89.

I claim:

1. A lead-free roof flashing material for providing a weathertight joint between an inclined roof surface and a building structure arranged therein, such as a main frame portion of a skylight, comprising a manually deformable sandwich structure including a stress damping and stabilizing core layer of a ductile material, a first foil sheeting completely covering one side of said core layer and a second foil sheeting at least partly covering the opposite side of said core layer, each of said foil sheetings having a thickness substantially less than said core layer and being shaped into flat-folded sections each comprising at least one inner layer in contact with said core layer, at least one intermediate layer extending substantially parallel with and close to said inner layer and joining said inner layer in a first folding line and an outer layer extending substantially parallel with and close to said intermediate layer and joining said intermediate layer in a second folding line parallel to said first folding line, a pair of said first folding lines extending at such a small distance from one another as to prevent said outer layer from contacting said core layer in a non-deformed state of said sandwich structure, but permit said outer layer to be contacted by said core layer upon an increase of said distance caused by manual deformation of said sandwich structure.

2. A roof flashing material as claimed in claim 1, wherein each of said flat-foled section is formed as an inverted pleat section with two inner layers and two intermediate layers joining said inner layers in a pair of said first folding lines and said outer layers in a pair of said second folding lines.

3. A roof flashing material as claimed in claim 1, wherein said core layer is of a material which is stretchable and adhesive at least in a temperature range from −5° C. to 60° C.

4. A roof flashing material as claimed in claim 3, wherein said core layer comprises an isobutyleneisoprene rubber as a main constituent.

5. A roof flashing material as claimed in claim 4, wherein said core layer has a thickness from 1 to 6 mm and said first and second foil sheetings are of aluminium foil with a thickness in the range of 0.1 to 0.5 mm.

6. A roof flashing material as claimed in claim 2, wherein said first folding lines in each of said inverted pleat sections extend densely close to one another.

7. A roof flashing material as claimed in claim 1, wherein each of said first and second foil sheetings is made from a continuous foil layer in which each inner layer of each said inverted pleat sections forms one inner layer of a neighbouring section.

8. A roof flashing material as claimed in claim 1, wherein said core layer is entirely encapsulated between said first and second foil sheetings.

9. A roof flashing material as claimed in claim 8, wherein said first and second foil sheetings are formed by a single foil sheeting which is folded around said core layer along a folding line extending substantially perpendicular to said first and second folding lines, whereas the free edges of said single foil are squeezed together.

10. A roof flashing material as claimed in claim 1, wherein apertures are provided in the outer layer of each inverted pleat section of said second foil sheeting.

11. A roof flashing material as claimed in claim 1, wherein said foil sheetings are made of a metallic material.

* * * * *

UNITED STATES PATENT AND TRADEMARK OFFICE

CERTIFICATE OF CORRECTION

PATENT NO. : 5,426,898

DATED : June 27, 1995

INVENTOR(S) : Niels A. Larsen

It is certified that error appears in the above-indentified patent and that said Letters Patent is hereby corrected as shown below:

Column 2, line 35, "place" should read "placed".

Column 3, line 65, after "core" insert ",".

Col. 5, Claim 2, line 2 "flat-foled" should read "flat-folded".

Col. 6, Claim 4, lines 2 and 3, "isobutyleneiso-prene" should read "isobutylene-isoprene".

Signed and Sealed this

Twelfth Day of September, 1995

*Attest:*

Bruce Lehman

BRUCE LEHMAN

*Attesting Officer*

*Commissioner of Patents and Trademarks*